US008151503B2

(12) United States Patent
Oz

(10) Patent No.: US 8,151,503 B2
(45) Date of Patent: Apr. 10, 2012

(54) ASSAULT RIFLE MAGAZINE EJECTOR EXTENSION

(75) Inventor: Moshe Oz, Ramat-Gan (IL)

(73) Assignee: Tactical Arms Ltd., Natania (IL)

( * ) Notice: Subject to any disclaimer, the term of this patent is extended or adjusted under 35 U.S.C. 154(b) by 0 days.

(21) Appl. No.: 12/978,765

(22) Filed: Dec. 27, 2010

(65) Prior Publication Data

US 2011/0154708 A1 Jun. 30, 2011

(30) Foreign Application Priority Data

Dec. 29, 2009 (IL) ..... 203060

(51) Int. Cl.
*F41A 9/00* (2006.01)

(52) U.S. Cl. ..... 42/49.01

(58) Field of Classification Search ..... 42/49.01, 42/7, 6, 50, 49.02
See application file for complete search history.

(56) References Cited

U.S. PATENT DOCUMENTS 1,401,152 A * 12/1921 Green ..... 42/50
5,628,134 A * 5/1997 Wesp et al. ..... 42/7
7,921,587 B2 * 4/2011 Mayberry ..... 42/6

* cited by examiner

*Primary Examiner* — Michael Carone
*Assistant Examiner* — Reginald Tillman, Jr.
(74) *Attorney, Agent, or Firm* — The Law Office of Michael E. Kondoudis

(57) ABSTRACT

A magazine ejector device that attaches to an automatic firearm is provided herein. One magazine ejection device includes a housing configured to at least partially surround a magazine locking lever on an automatic firearm. The housing includes a forward surface configured to press against a portion of a magazine during unlocking and cause a downward force on the magazine such that the magazine ejects from the firearm.

12 Claims, 1 Drawing Sheet

ASSAULT RIFLE MAGAZINE EJECTOR EXTENSION

CROSS REFERENCE TO RELATED APPLICATIONS

This application is a non-provisional patent application claiming priority to foreign Israeli patent application No. 203,060 filed on Dec. 29, 2009 which is incorporated herein in its entirety.

BACKGROUND

1. Technical Field

The present invention, in some embodiments thereof, relates to a magazine ejector that attaches to a magazine locking lever on an automatic weapon, and, more particularly, but not exclusively; to magazine ejector that attaches to a magazine locking lever on an assault rifle such as the Russian Avtomat Kalashnikova Modernizirovanniy (AKM) and the Israeli Galil.

2. Discussion of Related Art

The Kalashnikov assault rifle and its derivatives are generally known under the common name of AKM.

AKM assault rifles fire bullets which are fed into the firearm from a magazine. AKM magazines have a rectangular cross-section, and a curved profile when viewed from the side. The open top of an AKM magazine attaches to the underside of the firearm.

When all the rounds in an AKM magazine have been fired, ejection of the magazine requires the user to press a magazine locking lever with the hand which is located by the trigger, and pull the magazine off the firearm with the other hand which is located, on the AKM barrel.

Ejection of a magazine is a slow process that additionally delays a user combat readiness, for example maintaining a sight on a target. Any process that delays user combat-readiness can be life threatening.

BRIEF SUMMARY

Embodiments of the present invention provide a magazine ejector device that attaches to an automatic firearm. One magazine ejection device includes a housing configured to at least partially surround a magazine locking lever on an automatic firearm. Accordingly, according to an aspect of the present invention, the housing includes a forward surface configured to press against a portion of a magazine during unlocking, and cause a downward force on the magazine such that the magazine ejects from the firearm.

According to some embodiments of the invention, the housing is configured to attach to an AKM automatic firearm.

According to some embodiments of the invention, the housing is configured to create a force that causes the magazine to eject downwardly from the automatic firearm.

According to some embodiments of the invention, the housing includes flanges configured to aid a user in pressing the magazine ejector during at least one of: magazine unlocking; and magazine ejection.

According to some embodiments of the invention, the housing includes a channel configured to surround at least a portion of the magazine locking lever.

According to some embodiments of the invention, the housing is configured to be affixed forward of the trigger housing of the firearm.

According to some embodiments of the invention, the housing includes a ledge configured to align with a trigger housing of the firearm prior to activation of the magazine locking lever.

According to some embodiments of the invention, the housing includes at least one fixation receptacle configured to affix the housing in place on the magazine locking lever.

According to some embodiments of the invention, the at least one fixation receptacle comprises at least two fixation receptacles.

According to some embodiments of the invention, the at least two fixation receptacles are located on two sides of the magazine locking lever.

According to some embodiments of the invention, the forward portion of the housing includes a downwardly extending tab.

According to some embodiments of the invention, the downwardly extending tab is configured to apply at least a portion of the downward force during ejection.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
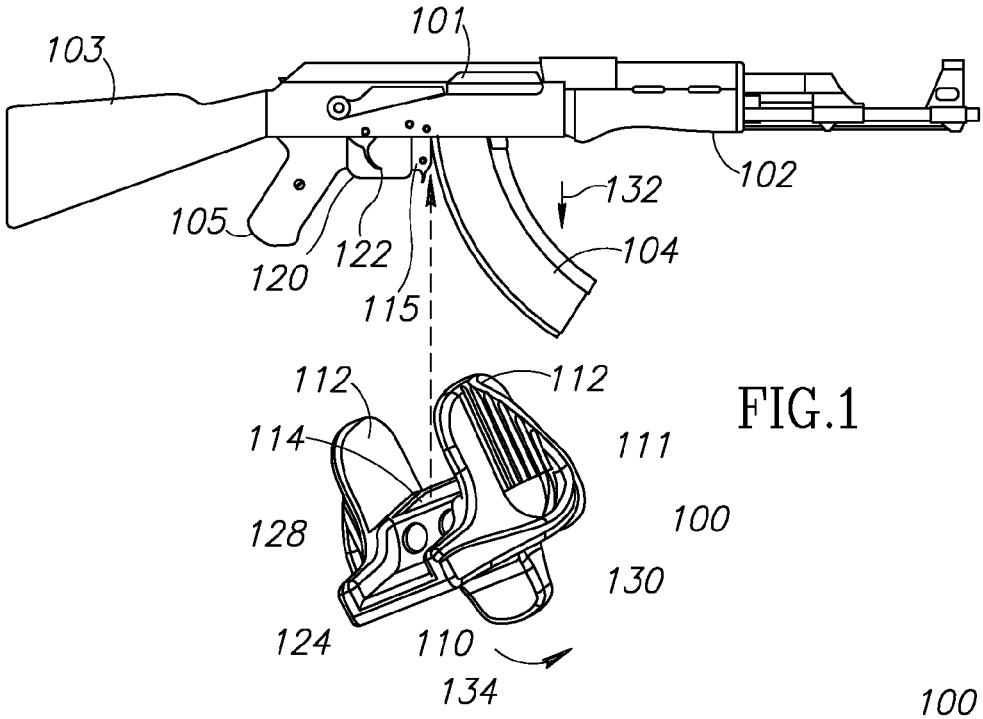
FIG. 1 shows a magazine ejector being positioned to mount on an AKM firearm, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 shows a magazine ejector 100 being positioned to mount on an AKM firearm 101, according to some embodiments of the invention.

AKM firearm 101 includes a butt 103, a barrel handgrip 102, and a weapon handle 105. Forward of weapon handle 105 is a trigger housing 120 surrounding a trigger 122.

A magazine locking lever 115 is configured to lock a magazine 104 in position under AKM firearm 101.

To unlock magazine 104, the user removes a first hand on weapon handle 105 and presses magazine locking lever 115 forward to move in a direction 134, towards barrel handgrip 102. The user then removes the second hand from barrel handgrip 102 and pulls magazine 104 in a downward motion 132 and removes magazine 104 from AKM firearm 101.

Magazine ejector 100 includes a housing 111 having a channel 114 configured to surround at least a portion of magazine locking lever 115 when magazine ejector 100 is in place. Magazine ejector 100 additionally includes flanges 112 configured to extend from either side of magazine locking lever 115 and aid a user in pressing the magazine ejector during a magazine unlocking procedure.

Magazine ejector 100 includes a ledge 124 configured to removably contact trigger housing 120, prior to activation forward of trigger housing 120.

Magazine ejector 100 additionally includes fixation apertures 128 configured to receive fixators, for example screws that affix the housing in place on magazine locking lever 115. While two fixation apertures 128 are shown that receive screws placed on either side of magazine locking lever 115, the present invention may be contemplated with any one of a number of configurations of fixation apertures 128. For example, fixation aperture 128 may be additionally or alternatively located centrally on magazine ejector 100 to receive a screw that pressed directly against magazine locking lever 115.

Magazine ejector 100 additionally includes a downwardly extending tab 110 having a planar forward surface 130.

Planar forward surface 130 is configured to press against a portion of magazine 104 during unlocking and cause a downward pressure in direction 132, that causes magazine 104 to downwardly disengage from AKM 101, thereby falling off AKM 101.

Figure 2:
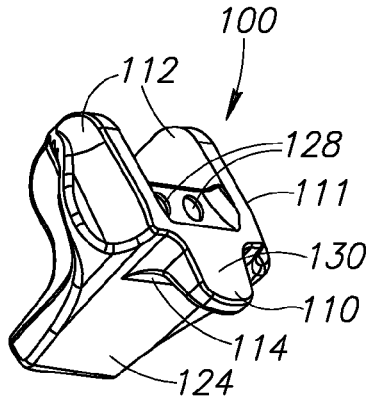
FIG. 2 shows further details of the magazine ejector shown in FIG. 1, according to some embodiments of the invention.

FIG. 2 shows details of magazine ejector 100, including lateral 112 flanges configured, for example, to optionally aid a user in placing magazine ejector 100 on magazine locking lever and/or to aid in activating magazine locking lever 115 as noted above.

Figure 3:
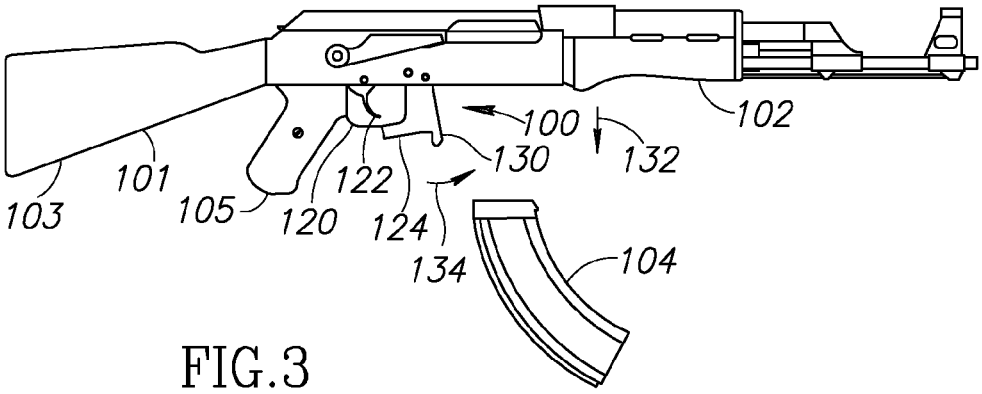
FIG. 3 shows the magazine ejector shown in FIG. 1 mounted on an AKM firearm during ejection of the magazine, according to some embodiments of the invention.

FIG. 3 shows magazine ejector 100 mounted on AKM firearm 101 following forward movement in direction 134, thereby causing magazine 104 to disengage from AKM 101 and fall in direction 132. Ledge 124 has disengaged from trigger housing 120 during activation, by pressing magazine ejector 100 to move in forward direction 134.

Figure 4:
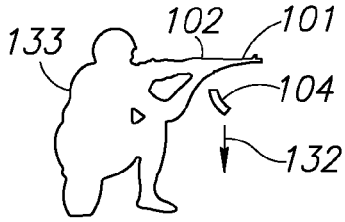
FIG. 4 shows a combatant ejecting the magazine shown in FIG. 3, according to some embodiments of the invention.

FIG. 4 shows a discovery of the inventors that while ejecting magazine 104, a combatant 133 may retain both hands in place on AKM 101.

The inventors have additionally discovered that following ejecting magazine 104, combatant 133 may be able to replace magazine 104 with the hand originally in place on trigger, while maintaining AKM 101 trained on a target with the other hand positioned on barrel handgrip 102.

The inventors have further discovered that magazine ejector may possibly facilitate a rapid ejection of magazine 104 during use of AKM 101.

In the above description, an embodiment is an example or implementation of the inventions. The various appearances of phrases like "one embodiment", "an embodiment", or "some embodiments", do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment", or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures, and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting", and grammatical variants thereof do not preclude the addition of one or more components, features, steps, or integers or groups thereof and that the terms are to be construed as specifying components, features, steps, or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can", or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques, and procedures for accomplishing a given task including, but not limited to, those manners, means, techniques, and procedures either known to, or readily developed from known manners, means, techniques, and procedures by practitioners of the art to which the invention belongs.

The descriptions, examples, methods, and materials presented in the claims and the specification are not to be construed as limiting, but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A magazine ejector device that attaches to an automatic firearm, the device comprising a housing configured to at least partially surround a magazine locking lever on an automatic firearm, the housing including a forward surface configured to press against a portion of a magazine during unlocking and cause a downward force on the magazine such that the magazine ejects from the firearm.

2. The device according to claim 1, wherein the housing is configured to attach to an AKM automatic firearm.

3. The device according to claim 2, wherein the housing is configured to create a force that causes the magazine to eject downwardly from the automatic firearm.

4. The device according to claim 1, wherein the housing includes flanges configured to aid a user in pressing the magazine ejector during at least one of: magazine unlocking; and magazine ejection.

5. The device according to claim 1, wherein the housing includes a channel configured to surround at least a portion of the magazine locking lever.

6. The device according to claim 1, wherein the housing is configured to be affixed forward of the trigger housing of the firearm.

7. The device according to claim 6, wherein the housing includes a ledge configured to align with a trigger housing of the firearm prior to activation of the magazine locking lever.

8. The device according to claim 1, wherein the housing includes at least one fixation receptacle configured to affix the housing in place on the magazine locking lever.

9. The device according to claim 8, wherein the at least one fixation receptacle comprises at least two fixation receptacles.

10. The device according to claim 9, wherein the at least two fixation receptacles are located on two sides of the magazine locking lever.

11. The device according to claim 1, wherein the forward portion of the housing includes a downwardly extending tab.

12. The device according to claim 11, wherein the downwardly extending tab is configured to apply at least a portion of the downward force during ejection.

* * * * *